United States Patent [19]

Loibl et al.

[11] 4,034,796

[45] July 12, 1977

[54] CONTINUOUS CASTING PLANT ROLLER STAND

[75] Inventors: Lorenz Loibl, Baden; Werner Scheurecker, Linz; Franz Kagerhuber, Traun; Alois Scheinecker; Günter Holleis, both of Linz, all of Austria

[73] Assignee: Vereinigte Osterreichische Eisen- und Stahlwerke-Alpine Montan Aktiengesellschaft, Linz, Austria

[21] Appl. No.: 718,568

[22] Filed: Aug. 30, 1976

[30] Foreign Application Priority Data

Sept. 3, 1975 Austria ..... 6782/75

[51] Int. Cl.[2] ..... B22D 11/12

[52] U.S. Cl. ..... 164/282

[58] Field of Search ..... 164/282, 283 S; 193/35 R; 226/189

[56] References Cited

U.S. PATENT DOCUMENTS 3,753,461 8/1973 Gallucci et al. ..... 164/282

FOREIGN PATENT DOCUMENTS 1,965,115 7/1971 Germany ..... 164/282

*Primary Examiner*—Robert D. Baldwin

*Attorney, Agent, or Firm*—Brumbaugh, Graves, Donohue & Raymond

[57] ABSTRACT

A roller stand to be used in continuous casting plants comprises two strand guide parts arranged opposite each other so as to guide the strand between them, which strand guide parts are held together by drawing anchors. The roller carrying means of one of the strand guide parts are movable relative to the strand by piston driving means. Overload protection means are provided within the area of the piston driving means and spacers maintain the distance between the opposing rollers.

3 Claims, 2 Drawing Figures

CONTINUOUS CASTING PLANT ROLLER STAND

BACKGROUND OF THE INVENTION

Figure 1:
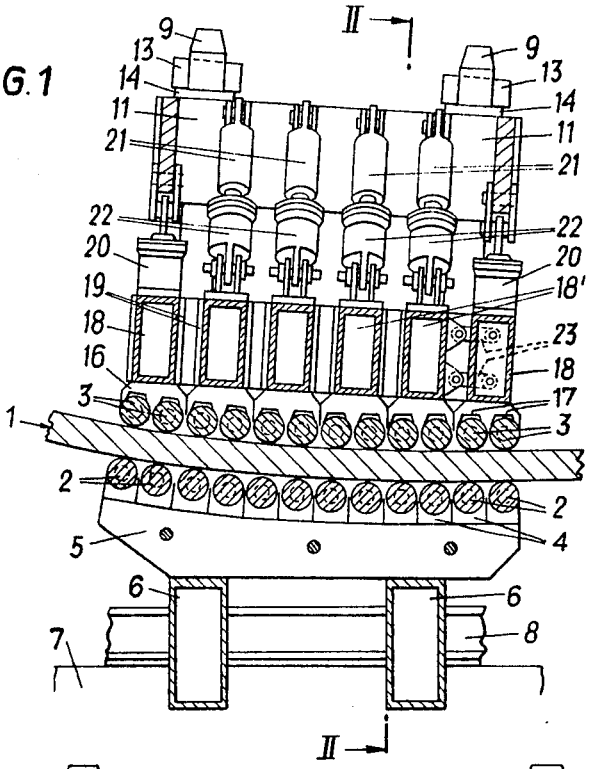

The invention relates to a roller stand for continuous casting plants having an inner and outer or upper and lower strand guide part, respectively, held together at the corners by drawing anchors. With these strands guide parts the rollers are arranged opposite each other on roller carriers. A roller carrier on one side of the strand surface is movable relative to the strand surface by piston driving means is guided in the stand by guiding faces. An overload protection comprised of a laminated spring or the like is being provided to guard against an excessive load on the rollers, and the distance between opposite rollers is fixable by means of spacers.

In modern continuous casting plants the strand is guided between two roller paths consisting of a plurality of rollers arranged closely adjacent one another. These rollers which guide and support the strand are arranged in roller stands, which have to meet numerous demands. The most important of these demands are:

easy adjustability of the roller distance, i.e. the distance between oposite roller paths;

reliable maintenance of the adjusted roller distance;

protection of the rollers against damage by the strand, e.g. by an end of the strand that has cooled too much;

ajustability of the rollers to the starter bar and to a strand of shrunken thickness;

easy and quick installation and removal of the rollers exposure of the strand to only those forces which are absolutely necessary, such as extraction, bending and straightening forces;

securing of the rollers against damage by a longitudinally twisted strand i.e., the rollers are to be resiliently mounted on one side at one end only;

use of construction elements able to endure the rough operation of a steel plant, which elements remain operative in spite of rust and scale desposits.

For a large part of the above mentioned task the construction elements which have proved best in practice are known. Thus laminated springs are known as overload protection, hydraulic piston driving means are known for roller adjustment and spacers are known for fixing the roller at a new distance when the thickness of the strand is changed (see Austrian Pat. No. 276,656, German Auslegeschrift No. 1,965,115). With these construction elements rollers stands have been built which, depend on the demands considered to be most important, have met only some of the above listed demands, but do not satisfy other requirements. The interaction of the individual construction elements is essential and in turn is dependent on their special arrangement in the roller stand.

SUMMARY OF THE INVENTION

It is the object of the invention to create a roller stand of the above-defined kind which meets all the above-listed demands in a satisfying manner. In particular, the rollers are also to be adjustable to a strand of shrunken thickness under controllable pressure without necessitating manipulations at the roller stand so that, when driven rollers are used, the transmission of the extraction force in maintained automatically. Furthermore, the rollers are to be effectively protected against overload and also the excessive forces caused by a longitudinally twisted strand are to be effectively reduced. Finally, the rollers of the roller stand according to the invention are to be especially easy to remove and install, without necessitating a removal from the roller stand of the means acting for an adjustment of the rollers to the surface of the strand and for an adjustment of a particular roller distance.

These objects of the invention are achieved in that two rollers are always arranged on a movable roller carrier, that the roller carriers are each actuated by two piston driving means, provided at their ends, the other ends of the piston driving means being secured to the stand at a distance exceeding the length of the movable roller carrier. The overload protection means are provided in the form of a laminated spring or the like within the piston driving means, i.e. between their articulation points on the roller carriers, on the one hand, and on the stand, on the other hand, and that the spacers are arranged on the drawing anchors connecting the inner and outer or upper and lower strand guide part, respectively.

According to a preferred embodiment, the movable roller carriers have a bowed guiding shape for those end faces lying perpendicular to the roller axis so as to guide the carriers in an approximately vertical direction relative to the strand surface. This enables a pivoting of the roller carriers perpendicularly to the guiding direction of the strand without the danger of jamming; however, a lateral yielding of the roller carriers is prevented.

Figure 2:
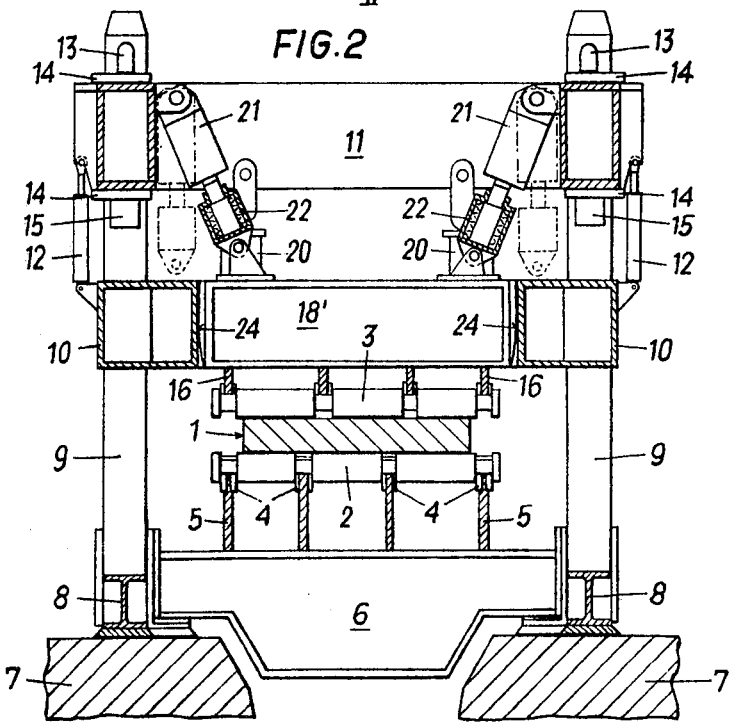

Advantageously, the two rollers arranged on a movable roller carrier are arranged in adjacent pocket-like recesses of supporting brackets secured to the roller carrier. BRIEF DESCRIPTION OF THE DRAWING The invention shall now be described in more detail by way of example only and with reference to the accompanying drawings, wherein:

FIG. 1 illustrates a longitudinal section parallel to the conveying direction of the strand through the roller stand designed, e.g., as the straightening path, and FIG. 2 is a section along line II—II of FIG. 1. DESCRIPTION OF AN EXEMPLARY EMBODIMENT The strand at its upper and lower sides, is supported, guided and straightened by the rollers 2 and 3. The rollers 2 allocated to the lower or outer side of the strand rest in supporting brackets 4 which are inserted in longitudinal carriers 5. Two transverse carriers 6 resting on the base 7 support the longitudinal carriers. The transverse carriers 6 are welded together with carriers 8 to form a frame construction. Four drawings anchors 9 arranged parallel to one another are rigidly arrranged at the corners of the frame. Two of them, i.e. those arranged at one side of the strand, are always rigidly connected to one another by a box-like carrrier 10. A frame 11 movable above these rigid box-like carriers along the drawing anchors is articulated to the box-like carriers 10 by means of four hydraulic cylinders 12 arranged at its corners. As a result the frame 11 can be lifted or lowered for adjusting a roller distance corresponding to the thickness of the strand by actuating the cylinders 12. For fixing the movable frame 11 at a certain height, spacers 14 are provided, which spacers are inserted, on the one hand, between wedges 13, arranged at the upper ends of the drawing anchors, and the movable frame 11, and, on the other hand, between consoles 15, welded onto the drawing anchors above the box- like carriers, and the frame 11.

The rollers 3 are allocated to the strand upper or inner side, are always arranged in pairs on roller carriers 18 and 18′ which extend in the longitudinal direction of the rollers. The rollers 3 are arranged in adjacent pocket- like recesses 17 of supporting brackets 16 which are secured to the roller carriers 18 and 18′. The roller carriers 18 and 18′are movable relative to one another. Also, they are guided on rail guides 19 of the laterally arranged box-like carriers 10 and are thus secured against turning. For reasons of space, only the last one of the roller carriers arranged in the conveying direction on the roller stand is articulated by means of guide rods 23 to the roller carrier arranged in front of it.

The two outermost roller carriers 18 arranged at the two ends of the roller stand are secured to the respective transversal bridges of the movable frame 11 with two intermediary pre-stressed laminated cup springs 20 each, which springs are articulated to the ends of the transversal bridges. Hydraulic cylinders 21 articulately engage the two ends of the remaining rollers carriers 18′ to the movable frame 11 such that the two hydraulic cylinders 21 pertaining to one roller carrier 18′ are secured on the frame 11 at a distance that exceeds the length of the roller carriers 18′. Within the articulation points of each one of the hydraulic cylinders 21, i.e. between their articulation points on the roller carriers 18′, on the one hand, and on the frame 11, on the other hand, overload protection means in the form of laminated cup springs 22 are provided. The springs of all the laminated springs 20 and 22 are under such a prestress that the rollers, when loaded by the ferrostatic pressure and the bending force only and at normal temperature, do not yield; yielding only occurs when the maximally allowable load acting on the rollers is exceeded. Thus the described casting thickness during the normal operation remains safeguarded. Only under an extreme load is the pre-stress overcome and the rollers 3 yield in the direction of the load. Advantageously, in the laminatad cup springs 20 and 22, spring excursion indicators are installed, which give an optic or acoustic signal when the laminated cup springs respond.

There is the possibility of using the signals of the spring excursion indicators for turning off the continuous casting plant, e.g., when the rollers are subjected to an especially high overload and a number of spring excursion indicators respond simultaneously. Such an overload may occur, e.g., when the extraction of a cooled-off strand from the plant is attempted.

By means of the hydraulic cylinders 21 the rollers, which may optionally be driven by a slip-on motor, can be adjusted to the starter bar or also to a hot strand that has shrunk in the direction of thickness. Thereby, a reliable transmission of the extraction force to the starter bar and to the hot strand can be achieved, if driven rollers are used.

For transporting the starter bar, the rollers are adjusted with only so much pressure that the permissible Hertzian pressure between roller and starter bar is not exceeded.

When the hot strand enters the straightening path, the pressure in the hydraulic cylinders 21 is reduced, so that the force acting on the strand is reliably less than the force caused by the ferrostatic pressure of the strand. Thus the rollers press the pistons of the hydraulic cylinders 21 into the final position due to the ferrostatic pressure, i.e. the rollers are hampered in their movement away from the strand surface. Bending forces that occur increase this effect. When the slab shrinks, the rollers follow the surface of the slab maintain and the contact, thus the transmission of the extraction force remains assured.

The roller carriers 18 and 18′ are inserted with play between the box-like carriers 10 and have bowed frontal faces 24, whereby jamming on the box-like carriers 10 is prevented, when the roller carriers yield, and a one- sided yielding of the roller carrier is made possible. Thus it becomes possible to extract longitudinally twisted strands without damaging the rollers.

The inclined arrangement of the hydraulic cylinders 21 according to the invention, which can be seen in FIG. 2, enables an especially easy removal and installation of the adjustable rollers. For roller removal, the hydraulic cylinders 21 are detached from the roller carrier 18′ carrying the roller to be removed by removing the bolt connecting these parts. The cylinders are then outwardly pivoted about the opposite articulation point on the frame 11, whereby the space necessary for lifting out the roller carrier 18′ together with the two rollers mounted thereon is created. This position is entered in FIG. 2 in dot-and-dash lines. The installation of the roller is effected by an opposite sequence.

The roller stand according to the invention can also be constructed in such a manner that all the roller carriers, including the two outer ones, are adjustable by hydraulic cylinders. It is also possible to omit the articulation of the roller carrier 18 arranged on the roller stand to the roller carrier 18′ arranged in front of it and also to guide this last roller carrier 18 with both of its ends in the box-like carriers 10.

What we claim is:

1. In a continuous casting plant roller stand of the type wherein two strand guiding parts are arranged opposite each other and are held together by drawing anchors, each of the strand guiding parts including roller carrying means on which rollers are arranged to lie opposite the rollers of the oppositely arranged strand guiding part, and wherein the roller carrying means of one of the strand guiding parts is movable relative to the surface of the strand to be cast by piston driving means and is guided in the roller stand, means protecting the rollers against overload, such as laminated springs, being provided and spacers to keep the rollers lying opposite each other at a predetermined distance, an improvement in one strand guiding part comprising:

said roller carrying means being a set of individually movable roller carriers carrying two rollers each, said piston driving means actuating at least some of the individually movable roller carriers and including two piston driving elements for each of the roller carriers to be actuated thereby, the piston driving elements at one of their ends being connected to opposite ends of the pertaining roller carrier and at their other ends to the roller stand in such a manner that their ends connected to the roller stand are spaced at a distance exceeding the length of the pertaining roller carrier, said means protecting the roller against overload being arranged at the ends of the piston driving elements, and said spacers being arranged at the drawing anchors.

2. A roller stand as set forth in claim 1, wherein the end faces of the roller carriers extending perpendicularly to the roller axes have a bowed guiding shape to provide for an approximately vertical guiding of the roller carrier relative to the strand.

3. A roller stand as set forth in claim 1, further comprising supporting brackets secured to the roller carriers, the supporting brackets being provided with adjacent pocket-like recesses for accommodating two rollers each.

* * * * *